US012031777B2

(12) United States Patent
Bahar et al.

(10) Patent No.: US 12,031,777 B2
(45) **Date of Patent: *Jul. 9, 2024**

(54) TUBE-IN-TUBE IONIC LIQUID HEAT EXCHANGER EMPLOYING A SELECTIVELY PERMEABLE TUBE

(71) Applicant: Xergy, Inc., Harrington, DE (US)

(72) Inventors: Bamdad Bahar, Georgetown, DE (US); Jacob Zerby, Dover, DE (US); Harish Opadrishta, Dover, DE (US); Jason Woods, Boulder, CO (US); Xiaobing Liu, Knoxville, TN (US)

(73) Assignee: FFI IONIX IP, INC., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/953,277

(22) Filed: Sep. 26, 2022

(65) Prior Publication Data

US 2023/0070246 A1 Mar. 9, 2023

Related U.S. Application Data

(63) Continuation of application No. 16/847,322, filed on Apr. 13, 2020, now Pat. No. 11,454,458.
(Continued)

(51) Int. Cl.
*F28D 21/00* (2006.01)
*F25B 15/14* (2006.01)
(Continued)

(52) U.S. Cl.
CPC ..... *F28D 21/0015* (2013.01); *F25B 15/14* (2013.01); *F25B 37/00* (2013.01); *F28D 7/103* (2013.01); *F28D 20/003* (2013.01)

(58) Field of Classification Search
CPC .... F25B 15/14; F25B 37/00; F25B 3215/002; F28D 7/103; F28D 21/0015
See application file for complete search history.

(56) References Cited

U.S. PATENT DOCUMENTS 1,925,281 A 3/1934 Ranque
2,913,511 A 11/1959 Grubb, Jr.
(Continued)

FOREIGN PATENT DOCUMENTS

GB 235009 A 10/2016
WO 9106691 5/1991
(Continued)

OTHER PUBLICATIONS

"Engineering a Membrane Electrode Assembly," John W. Weidner et al., The Electrochemical Society Interface, Winter, 2003, pp. 40-43.
(Continued)

*Primary Examiner* — Devon Russell
(74) *Attorney, Agent, or Firm* — Invention To Patent Services; Alex Hobson

(57) ABSTRACT

A tube-in-tube heat exchanger utilizes a selectively permeable tube having a selective permeable layer to allow the refrigerant to transfer into an ionic liquid to generate heating or cooling. The ionic liquid then provides heating or cooling to a heat transfer fluid through a non-permeable layer or tube. The system may be configured as a shell and tube design, with the third fluid free to flow on the outside of the shell, or as a shell and tube-in-tube, with a central tube containing a first liquid, a second tube containing a second liquid, and an outer shell containing the third liquid. The selectively permeable tube may include an anion or cation selectively permeable layer and this layer may be supported by a support layer or tube.

20 Claims, 5 Drawing Sheets

Related U.S. Application Data

(60) Provisional application No. 62/833,513, filed on Apr. 12, 2019.

(51) Int. Cl.

| | |
|---|---|
| ***F25B 37/00*** | (2006.01) |
| ***F28D 7/10*** | (2006.01) |
| ***F28D 20/00*** | (2006.01) |

(56) References Cited

U.S. PATENT DOCUMENTS

| | | | |
|---|---|---|---|
| 3,432,355 | A | 3/1969 | Niedrach et al. |
| 3,489,670 | A | 1/1970 | Maget |
| 3,544,377 | A | 12/1970 | Justi et al. |
| 4,118,299 | A | 10/1978 | Maget |
| 4,402,817 | A | 9/1983 | Maget |
| 4,523,635 | A | 6/1985 | Nishizaki et al. |
| 4,593,534 | A | 6/1986 | Bloomfield |
| 4,829,785 | A | 5/1989 | Hersey |
| 4,990,412 | A | 2/1991 | Hersey |
| 5,024,060 | A | 6/1991 | Trusch |
| 5,547,551 | A | 8/1996 | Bahar et al. |
| 5,599,614 | A | 2/1997 | Bahar et al. |
| 5,635,041 | A | 6/1997 | Bahar et al. |
| 5,746,064 | A | 5/1998 | Tsenter |
| 5,768,906 | A | 6/1998 | Tsenter |
| 5,900,031 | A | 5/1999 | Bloomfield |
| 5,961,813 | A | 10/1999 | Fritz et al. |
| 5,976,724 | A | 11/1999 | Bloomfield |
| 5,993,619 | A | 11/1999 | Bloomfield et al. |
| 6,068,673 | A | 5/2000 | Bloomfield |
| 6,167,721 | B1 | 1/2001 | Tsenter |
| 6,254,978 | B1 | 7/2001 | Bahar et al. |
| 6,321,561 | B1 | 11/2001 | Magel |
| 6,425,440 | B1 | 7/2002 | Tsenter et al. |
| 6,553,771 | B2 | 4/2003 | Tsenter |
| 6,635,384 | B2 | 10/2003 | Bahar et al. |
| 6,994,929 | B2 | 2/2006 | Barbir et al. |
| 8,640,492 | B2 | 2/2014 | Bahar |
| 8,769,972 | B2 | 7/2014 | Bahar |
| 9,005,411 | B2 | 4/2015 | Bahar et al. |
| 2002/0066277 | A1 | 6/2002 | Tsenter |
| 2003/0141200 | A1 | 7/2003 | Harada |
| 2003/0155252 | A1 | 8/2003 | Juda et al. |
| 2003/0196893 | A1 | 10/2003 | Mcelroy et al. |
| 2004/0040862 | A1 | 3/2004 | Kosek |
| 2004/0142215 | A1 | 7/2004 | Barbir et al. |
| 2005/0072688 | A1 | 4/2005 | Melster |
| 2005/0274138 | A1 | 12/2005 | Golden |
| 2006/0230765 | A1 | 10/2006 | Fedorov et al. |
| 2006/0254286 | A1 | 11/2006 | Johnson et al. |
| 2008/0187794 | A1 | 8/2008 | Weingaetner |
| 2009/0214905 | A1 | 8/2009 | Narayanan et al. |
| 2009/0308752 | A1 | 12/2009 | Evans et al. |
| 2010/0132386 | A1 | 6/2010 | Bahar |
| 2011/0198215 | A1 | 8/2011 | Bahar |
| 2011/0256463 | A1 | 10/2011 | Michalske et al. |
| 2017/0138653 | A1 | 5/2017 | Bahar |
| 2018/0187906 | A1* | 7/2018 | Bahar ..... F24F 3/1417 |

FOREIGN PATENT DOCUMENTS

| | | | |
|---|---|---|---|
| WO | 0125700 | A1 | 4/2001 |
| WO | 007108 | A1 | 1/2008 |
| WO | WO2008154984 | A1 | 12/2008 |
| WO | 2010127270 | A2 | 4/2010 |
| WO | WO2010127270 | A2 | 11/2010 |
| WO | 2013096890 | A1 | 6/2013 |

OTHER PUBLICATIONS

Technical Specifications for "HOGEN Hydrogen Generation Systems," Proton Energy Systems, Inc., Oct. 2008, 2 pages.

"Teledyne Titan(TM) HM Generator Series Hydrogen/Oxygen Gas Systems," Teledyne Energy Systems, Inc., Jun. 2007, 2 pages.

"A Comparative Study of Water as a Refrigerant with Some Current Refrigerants", International Journal of Energy Research, Int. J. energy res. 2005: 29.947-959.

* cited by examiner

TUBE-IN-TUBE IONIC LIQUID HEAT EXCHANGER EMPLOYING A SELECTIVELY PERMEABLE TUBE

CROSS REFERENCE TO RELATED APPLICATIONS

This application claims the benefit of priority to U.S. provisional patent application 62/833,513, filed on Apr. 12, 2020.

STATEMENT OF GOVERNMENT LICENSE RIGHTS

This invention was made with United States government support under Contract No. DE-AC36-08GO28308 awarded by the United States Department of Energy. The government has certain rights in this invention.

FIELD OF THE INVENTION

The invention relates to a tube-in-tube heat exchanger that utilizes a selectively permeable tube having a selective permeable layer to allow a refrigerant to transfer into an ionic liquid to generate heating or cooling.

BACKGROUND

The absorption refrigeration cycle has been in use in various forms for more than 100 years. Although the vapor compression cycle is now used for most air-conditioning and refrigerating applications, the well-known refrigerant-absorber systems ($H_2O$/LiBr and $NH_3/H_2O$) are still being used for certain applications, particularly in the field of industrial applications or large-scale water chiller systems. Recently, more attention has been directed toward recovery of waste heat using the $NH_3/H_2O$ system (Erickson. D. C., et al (ASH RAE Trans., 2004, 110). Inherent drawbacks to using LiBr and $NH_3$ as refrigerants include the corrosiveness of LiBr and the toxicity and flammability of $NH_3$. Recently, absorption cooling cycles using water+room-temperature ionic liquids (RTILs) have been proposed as a replacement for the water+LiBr system.

Achieving heating and cooling of a process stream through absorption cycles requires interaction of a first fluid, or refrigerant, with the ionic liquid, or absorbent, to generate the heating or cooling based on the heat of absorption, and capturing the heating or cooling with the process stream or heat transfer fluid. There is therefore a need for a three-fluid heat exchanger for interacting the refrigerant, the absorbent, and heat transfer fluid. Three fluid heat exchangers are known and typically utilize plate and frame configurations, which have several key disadvantages. They have dead zones were fluids are entrained, providing poor transfer properties. The plate and frame designs require narrow flow channels, which have a high pressure drop in the system and must be overcome with additional pumping energy. It also difficult to achieve adequate sealing against the ionic liquids; the salt solutions are corrosive and tend to leak through any gasket seals.

SUMMARY OF THE INVENTION

The invention is directed to a tube-in-tube heat exchanger that utilizes a selectively permeable tube having a selective permeable layer to allow the refrigerant to transfer into the ionic liquid to generate heating or cooling. The ionic liquid then provides heating or cooling to the heat transfer fluid through a non-permeable layer. The system may be configured as a shell and tube design, with the third fluid free to flow on the outside of the shell, or as a shell and tube-in-tube, with a central tube containing a first liquid, a second tube containing a second liquid, and an outer shell containing the third liquid.

The tube design reduces pressure drop in the system and improves sealing as the ends of the tubes are the only place the require sealing. Sealing the ends of the tubes can be done by potting, or other means known by those skilled in the art of shell and tube exchanger design.

In an exemplary embodiment, the selectively permeable layer is made of a membrane that allows the refrigerant to selectively permeate through but contains the ionic liquid. This reduces contamination and crossover of the ionic liquid through the permeable layer. An exemplary selectively permeable layer may be an ionomer, such as a perfluorosulfonic acid polymer.

The selectively permeable layer may be a composite comprising a support material that is coated and/or imbibed with an ion selective material, such as a polymer. An exemplary selectively permeable layer is an ionomer, such as Nafion® membrane, from E.I. DuPont, Inc, Wilmington, Delaware, or Gore-Select® membrane from W.L. Gore and Associates, Inc., Newark, Delaware Note that Gore-Select® is a composite proton selective membrane that is reinforced with expanded polytetrafluoroethylene (PTFE), a fluoropolymer membrane.

An exemplary selectively permeable layer may comprise an anion conducting polymer that comprises quaternary ammonium or phosphonium functional groups, with poly (styrene), poly(phenylene), polybenzimidazole or poly (arylene) backbones. Rigid, aromatic polymer backbones such as poly(phenylene) or poly(arylene) provide high tensile strength along with resistance to chemical degradation via hydroxide elimination reactions in a highly caustic environment.

An exemplary selectively permeable layer may comprise an ion exchange membrane comprising an ionomer that can further be reinforced by porous support materials, such as microporous polytetrafluoroethylene, polyethylene, polyvinylidene fluoride, polyether ether ketone or polypropylene membranes. Reinforcing the ionomer with the porous support matrix, creates a composite anion exchange membrane. The preferred microporous support for use in the present invention is porous ultra-high molecular weight polyethylene, as it has superior chemical compatibility, compared to expanded polytetrafluoroethylene, the standard for reinforced cation exchange membranes and porosity, compared to polypropylene, an alternative polyolefin support. An exemplary ion exchange membrane or selectively permeable layer, for use in the present invention comprises a polymer with a poly(arylene) or poly(phenylene) backbone and alkyl or piperidine side chains featuring quaternary ammonium or phosphonium groups for ionic conductivity. In an exemplary embodiment, a solution of this ionomer is impregnated into a microporous polyolefin support for greater reinforcement and stability, especially at lower thickness.

An exemplary selectively permeable layer may be an anion conducting layer that is a composite anion conducting layer comprising an anion conducting polymer that is reinforced by a support material. An even more desirable example of the present invention involves impregnating a microporous polyolefin support material between 5 and 100 microns, with porosity ranging from approximately 50% to 90% and pore size between approximately 20 nm and 1 micron, with a polymer solution comprising a precursor form of the ionomer comprising tertiary amine groups grafted to a poly(arylene) or poly(phenylene) backbone, along with a crosslinking agent such as divalent metal cations, tetramethyl-1,6-hexanediamine, or 4,4'-trimethylenebis(1-methyl-piperidine), and then exposing the dried composite membrane to trimethylamine solution in water or ethanol. The crosslinking can be initiated or accelerated by exposure to high temperatures as well as infrared or ultraviolet radiation.

An exemplary selectively permeable layer may be an anion conducting layer that is an anisotropic anion conducting layer, that has varying properties through the thickness of the layer and may comprise a series of thin films fused together to create an anisotropic membrane. Typically, quaternary ammonium ions are the cationic site and the backbone is varied, however it is possible to create cationic species with phosphonium as the cationic center. The number of layers can be altered as well as step changes in the blend ratio to generate membranes of significantly anisotropic internal structures.

The selectively permeable layer may comprise an anion conducting polymer within an anion conducting layer may be crosslinked using a crosslinking agent or compound. Anion conducting polymers, such as within a composite anion conducting layer, may be crosslinked to increase their mechanical and chemical stability, especially in hydrated conditions. In the case of an anionic ionomer with functional quaternary ammonium groups, crosslinks may be made between polymer chains by linking quaternary ammonium groups together with crosslinking agents such as polyamines, blocked polyamines, dicyanodiamides, divalent metal cations, tetramethyl-1,6-hexanediamine, 4,4'-trimethylenebis(1-methyl-piperidine), or 4,4'-(1,3-Propanediyl)bis(1-methyl-piperidine). A composite anion conducting layer may be formed by imbibing a support material with a polymer solution containing the ionomer along with one of the above crosslinking agents at a prescribed molar ratio of crosslinking agent to functional ionic groups. These membranes are characterized by nano-scale channels that essentially hold water and conduct anions, such as hydroxyl ions. These new anion exchange membranes have demonstrated the ability to achieve high conductivity for anions or high permselectivity.

An exemplary selectively permeable layer may include a non-ionic transfer medium that transfers polar compounds but does not necessarily transfer ionic compounds. An exemplary non-ionic selectively permeable layer includes a non-ionic transfer medium including, but limited to, starch, ethylene-vinyl alcohol copolymer, optionally modified, and hydrophobic polymers of polyethylene or of its vinyl copolymers such as those mentioned above, or aliphatic polyesters (e.g. polyvinyl acetate, poly-epsilon caprolactone, polyhydroxybutyrate (PHB) and polyhydroxybutyrate valerate (PHBV), polylactic acid, polyethylene and polybutylene adipates or sebacates), polyethers (e.g. polyoxymethylene, polyoxyethylene, polyoxypropylene, polyphenylene oxide), polyamides (nylon 6, nylon 12, etc.), polyacrylonitrile, polyurethanes, polyester/polyurethane copolymers, polyester/polyamide copolymers, polyglycolide, hydrophilic polymers such as polyvinylpyrrolidone, polyoxazoline, cellulose acetates and nitrates, regenerated cellulose, alkyl cellulose, carboxymethyl cellulose, casein-type proteins and salts thereof, natural gums such as gum arabic, algin and alginates, chitin and chitosan. Preferred non-ionic compounds include Ethylene-vinyl alcohol copolymer, polyethylene, polyester, polyether, polyamide, polyacrylonitrile, polyurethane, polyglycolide, polyvinylpyrrolidone, polyoxazoline or cellulose-based, or copolymers thereof.

An exemplary selectively permeable layer may include polymer formulations may be mixed, or polymers may be in blocks to form block copolymers.

The selectively permeable layer, may be very thin, such as less than 25 microns, less than 20 microns and more preferably less than 15 microns. A thin selectively permeable layer is preferred as it will allow for higher rates of ion transport and better efficiency of the system. The support material or layer for a composite selectively permeable layer, such as an expanded fluoropolymer support membrane, may be thin, such as such as less than 25 microns, less than 20 microns and more preferably less than 15 microns.

An exemplary ionic liquid may be an exothermic ionic liquid or an endothermic ionic liquids depending on their heat of absorption. Ionic liquids suitable for use herein may have a cation selected from the group consisting of pyridinium, pyridazinium, pyrimidinium, pyrazinium, imidazolium, pyrazolium, thiazolium, oxazolium, triazolium, phosphonium, and ammonium as defined above; and an anion selected from the group consisting of $[CH_3CO_2]^-$, $[HSO_4]^-$. $[CH_3OSO_3]^-$, $[C_2H_5OSO_3]^-$, $[AlCl_4]^-$, $[CO_3]^{2-}$, $[HCO_3]^-$, $[NO_2]^-$, $[NO_3]^-$, $[SO_4]^{2-}$, $[PO_4]^{3-}$, $[HPO_4]^{2-}$, $[H_2PO_4]^-$, $[HSO_3]-$, $[CuCl_2]-$, $Cl^-$, $Br^-$, $I^-$, $SCN^-$, $[BF_4]^-$, $[PF_6]^-$, $[SbF_6]^-$, $[CF_3SO_3]^-$, $[HCF_2CF_2SO_3]^-$, $[CF_3HFCCF_2SO_3]^-$, $[HCClFCF_2SO_3]^-$, $[(CF_3SO_2)_2N]^-$, $[(CF_3CF_2SO_2)_2N]^-$, $[(CF_3SO_2)_3C]^-$, $[CF_3CO_2]^-$, $[CF_3OCFHCF_2SO_3]^-$, $[CF_3CF_2OCFHCF_2SO_3]^-$, $[CF_3CFHOCF_2CF_2SO_3]^-$, $[CF_2HCF_2OCF_2CF_2SO_3]^-$, $[CF_2ICF_2OCF_2CF_2SO_3]^-$, $[CF_3CF_2OCF_2CF_2SO_3]^-$, $[(CF_2HCF_2SO_2)_2N]^-$, $[(CF_3CFHCF_2SO_2)_2N]^-$, and $F^-$.

In addition, an exemplary ionic liquid may be a synthetic organic salt ionic liquid solution such as emimoac (an acetate compound) that is less corrosive to metals than traditional ionic liquid salt solutions. The use of a synthetic salt may be preferred in the system to reduce corrosion and increase durability of the system.

The invention is directed at a three-phase heat exchanger that utilizes selectively permeable tubes configured in a tube-in-tube heat exchanger. The selectively permeable tubes are selectively permeable and allow the refrigerant to permeate through and absorb in the ionic liquid but stop the ionic liquid from escaping.

In an exemplary embodiment, a first, central tube contains the heat transfer fluid to carry out heat exchange, with the ionic liquid contained in a second tube surrounding the central heat exchange tube (this is typically known as shell and tube). The central tube is made of a non-permeable material, and may comprise of metals, plastics, or membrane tubes that do not allow transfer of either fluid. The refrigerant is in contact with the outside of the shell and tube assembly and is configured in a third tube, now providing a shell and tube-in-tube design. The outside of the second tube comprises a selectively permeable layer, such as a membrane to allow the transfer of the refrigerant into the ionic liquid. The third tube, also known as the shell in this embodiment, is made of a non-permeable material, and may comprise of metals, plastics, or membrane tubes that do not allow transfer of the refrigerant out of the system.

In an exemplary embodiment, a first, central tube contains the heat transfer fluid to carry out heat exchange, with the ionic liquid contained in a second tube surrounding the central heat exchange tube (this is typically known as shell and tube). The central tube is made of a non-permeable material, and may comprise of metals, plastics, or membrane tubes that do not allow transfer of either fluid. The refrigerant is in contact with the outside of the shell and tube assembly and is not contained in a tube assembly, providing refrigerant to the shell and tube assembly. The outside of the second tube comprises a selectively permeable layer, such as a membrane, to allow the transfer of the refrigerant into the ionic liquid.

In an exemplary embodiment, a first, central tube contains the refrigerant, with the ionic liquid contained in a second tube surrounding the central tube (this is typically known as shell and tube). The central tube is made of a permeable material, to allow the transfer of the refrigerant into the ionic liquid. The heat transfer fluid is in contact with the outside of the shell and tube assembly and is configured in a third tube, now providing a shell and tube-in-tube design. The outside of the second tube is made of a non-permeable material, and may comprise of metals, plastics, or membrane tubes that do not allow transfer of either fluid. The third tube, also known as the shell in this embodiment, is made of a non-permeable material, and may comprise of metals, plastics, or membrane tubes that do not allow transfer of the heat transfer fluid out of the system.

In an exemplary embodiment, a first, central tube contains the refrigerant, with the ionic liquid contained in a second tube surrounding the central tube (this is typically known as shell and tube). The central tube is made of a permeable material, to allow the transfer of the refrigerant into the ionic liquid. The heat exchange fluid is in contact with the outside of the shell and tube assembly and is not contained in a tube assembly, providing refrigerant to the shell and tube assembly. The outside of the second tube is made of a non-permeable material, and may comprise of metals, plastics, or membrane tubes that do not allow transfer of either fluid. The heat exchange fluid as discussed in this embodiment may also be the process flow.

An exemplary assembly of any of the previous embodiments may have potting to seal the end of the tube assemblies. The potting acts to seal off the various flows from leaking and improves manufacturability of the final assembly. The potting may comprise of a two-part epoxy, or other potting materials used in filtration and shell and tube design.

An exemplary selectively permeable tube may be manufactured as an extruded material, wrapped material to form a tube, spiral wound, or hollow fiber depending on the required packing density, system pressure drop, and application. All selectively permeable tube configurations allow for shell and tube, or shell and tube-in-tube configurations. The selectively permeable tube may be free standing, or a composite tube with a reinforcement structure. The selectively permeable layer may be a composite of a selectively permeable material that is supported a support material or layer that may be integrated into the membrane. A composite selectively permeable layer allows for very thin structures to be produced to improve permeation rates, while having the structural integrity of thick-walled tubing. The tube may require external reinforcement as well with a braiding to restrict expansion of the material.

An exemplary refrigerant may comprise water, ammonia, carbon dioxide, or other refrigerants which can permeate through a selectively permeable layer and absorb into the ionic liquid. Other refrigerant choices are possible and known by those skilled in the art. The ionic liquid and selectively permeable layer must be appropriately selected for the refrigerant used in the heat exchanger system.

An exemplary non-permeable tube for heat transfer can be constructed from thermally conductive materials but that are still corrosion resistant by employing a thermally conductive plastic material. In embodiments such a plastic has a thermal conductance of about 5 to 10 W/mK. As an example, thermal conductances for regular plastics range from 0.1 to 0.5 W/mK, whereas Copper, Aluminum, Stainless Steel and Titanium have a conductance of about 400, 250, 16 and 18 W/mK respectively. Of these materials only Titanium is reasonably suitable for use with desiccants such as CaCl2 or LiCl2 due to the corrosive nature of the desiccants The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
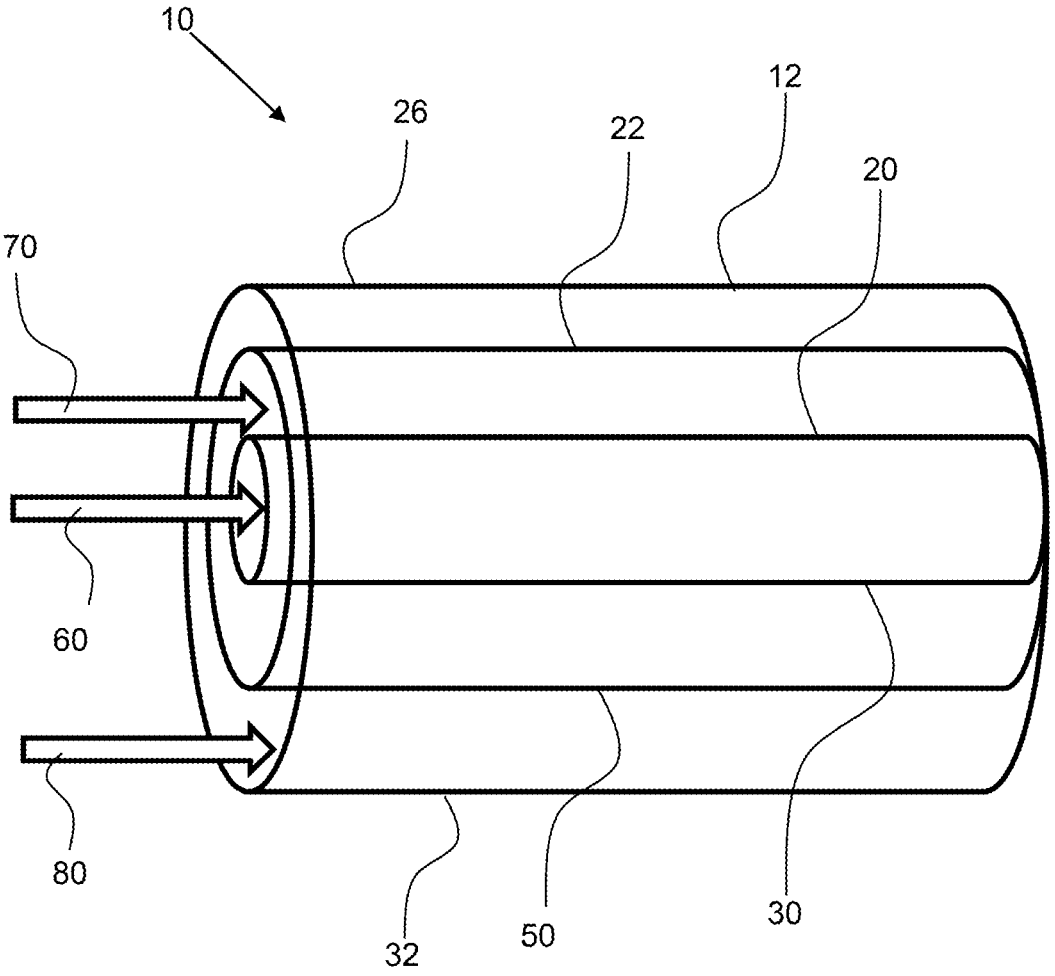
FIG. 1 shows a perspective view of an exemplary tube-in-tube heat exchanger having an inner tube that is a non-permeable tube with a heat transfer fluid flowing therethrough surrounded by a selectively permeable tube having an ionic liquid flowing therethrough and an outer shell having a refrigerant fluid flowing therethrough.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion.

For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

FIG. 1 shows a perspective view of a heat exchanger 10 comprising an exemplary tube-in-tube heat exchanger 12 having a inner tube 20 that is a non-permeable tube 30 with a heat transfer fluid 60 flowing therethrough surrounded by an outer tube 22 that is a selectively permeable tube 50 having an ionic liquid 70 flowing therethrough. An outer shell 26 that is a non-permeable tube 32 has a refrigerant fluid 80 flowing therethrough.

Figure 2:
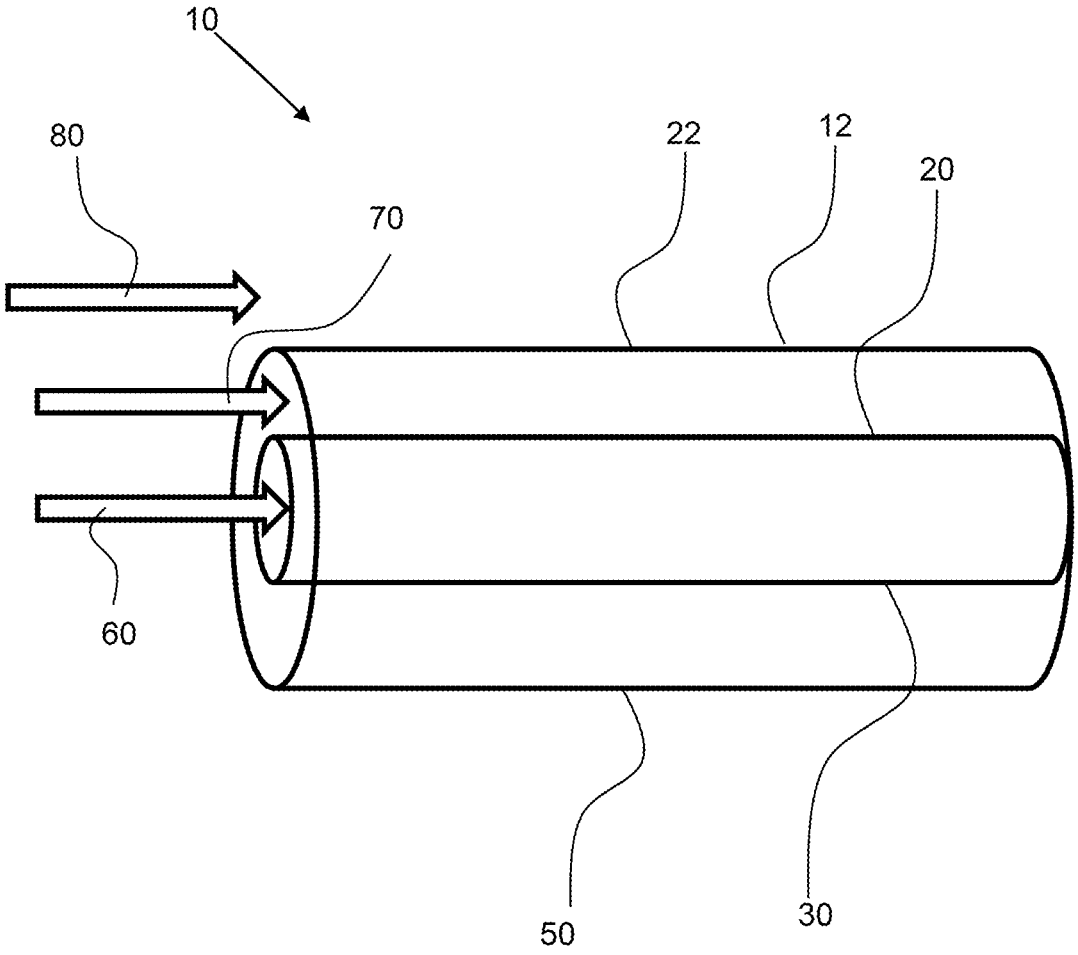
FIG. 2 shows a perspective view of an exemplary tube-in-tube heat exchanger having an inner tube that is a non-permeable tube with a heat transfer fluid flowing therethrough surrounded by a selectively permeable tube having an ionic liquid flowing therethrough and a refrigerant fluid flowing over the outer tube.

FIG. 2 shows a perspective view of a heat exchanger 10 comprising an exemplary tube-in-tube heat exchanger 12 having an inner tube 20 that is a non-permeable tube 30 with a heat transfer fluid 60 flowing therethrough surrounded by an outer tube 22 that is a selectively permeable tube 50 having an ionic liquid 70 flowing therethrough.

Figure 3:
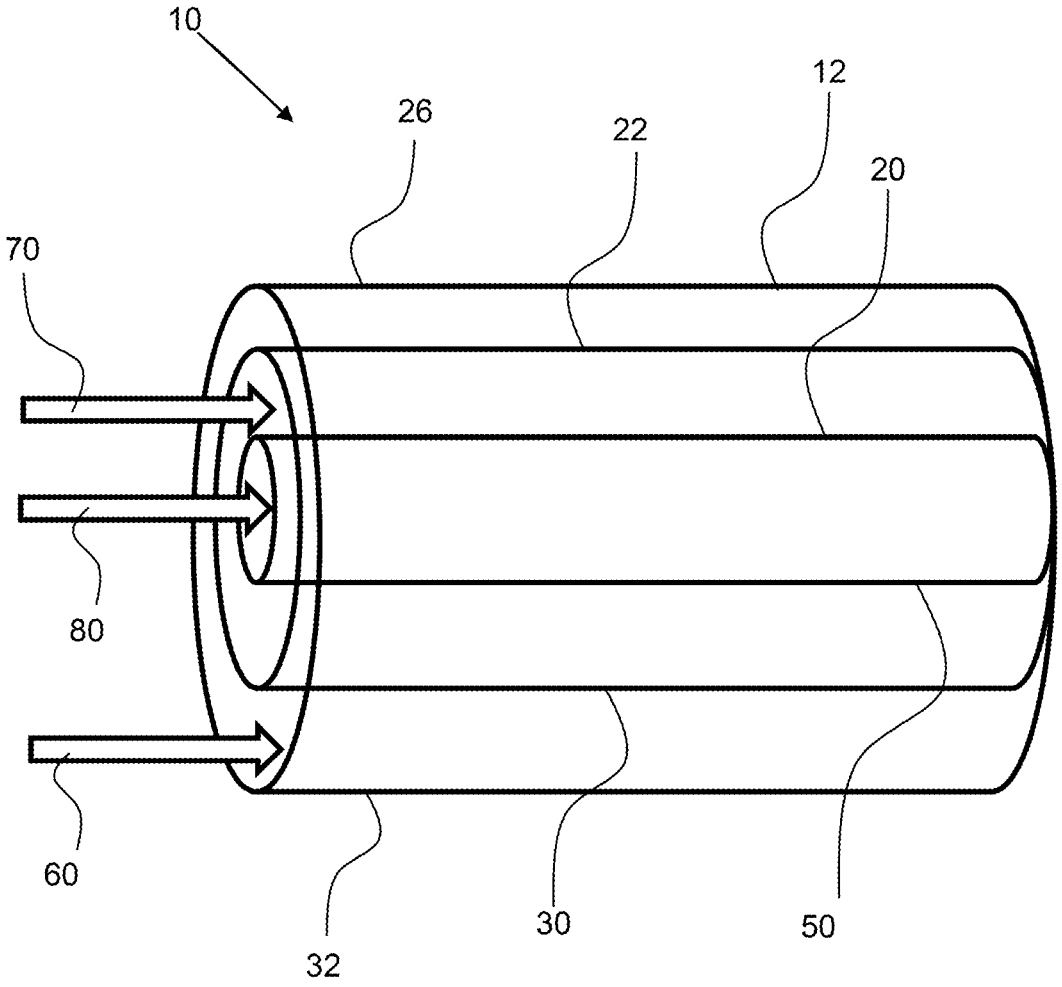
FIG. 3 shows a perspective view of an exemplary tube-in-tube heat exchanger having an inner tube that is a selectively permeable tube with a refrigerant flowing therethrough surrounded by a non-permeable tube having an ionic liquid flowing therethrough and an outer shell having a heat transfer fluid flowing therethrough.

FIG. 3 shows a perspective view of a heat exchanger 10 comprising an exemplary tube-in-tube heat exchanger 12 having an inner tube 20 that is a selectively permeable tube 50 with a refrigerant fluid 80 flowing therethrough surrounded by an outer tube 22 that is a non-permeable tube 30 having an ionic liquid 70 flowing therethrough. An outer shell 26 that is a non-permeable tube 32 has a heat transfer fluid 60 flowing therethrough.

Figure 4:
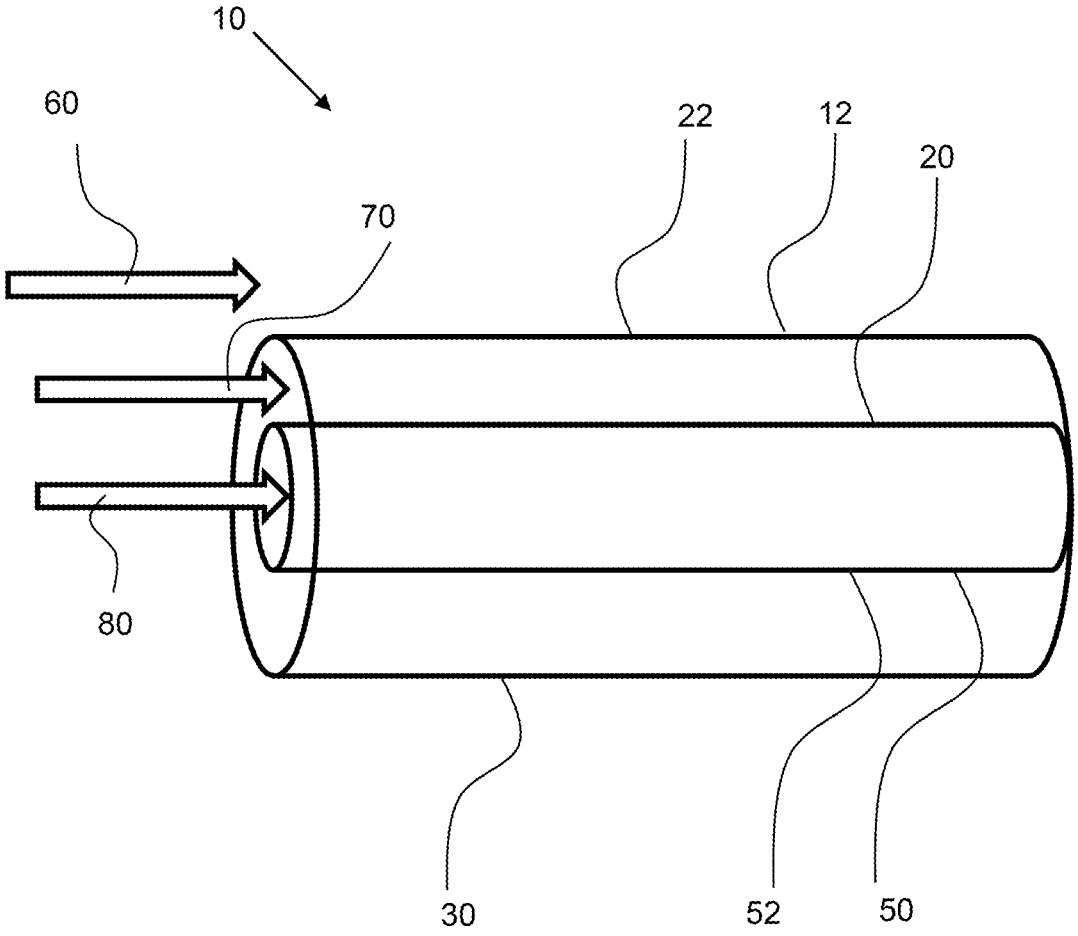
FIG. 4 shows a perspective view of an exemplary tube-in-tube heat exchanger having an inner tube that is a selectively permeable tube with a refrigerant flowing therethrough surrounded by a non-permeable tube having an ionic liquid flowing therethrough and a flow of heat transfer fluid over the outer tube.

FIG. 4 shows a perspective view of a heat exchanger 10 comprising an exemplary tube-in-tube heat exchanger 12 having an inner tube 20 that is a selectively permeable tube 50 with a refrigerant fluid 80 flowing therethrough surrounded by an outer tube 22 that is a non-permeable tube 30 having an ionic liquid 70 flowing therethrough.

Figure 5:
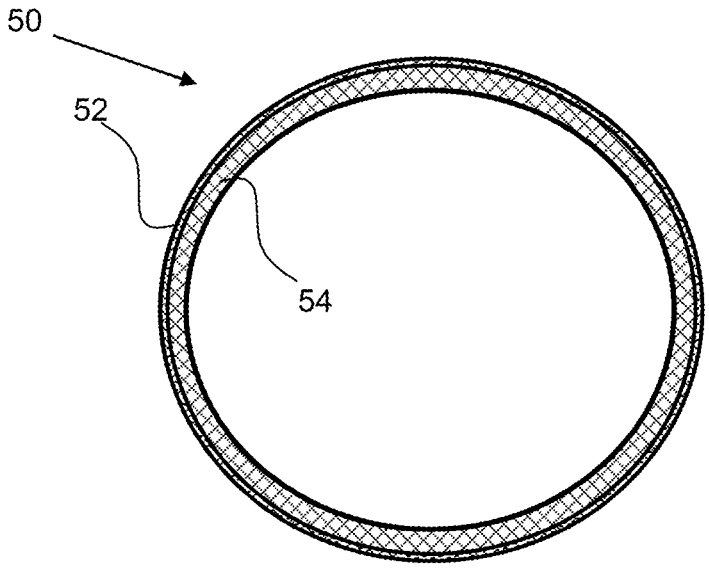
FIG. 5 shows a cross sectional view of a selectively permeable tube.
Figure 6:
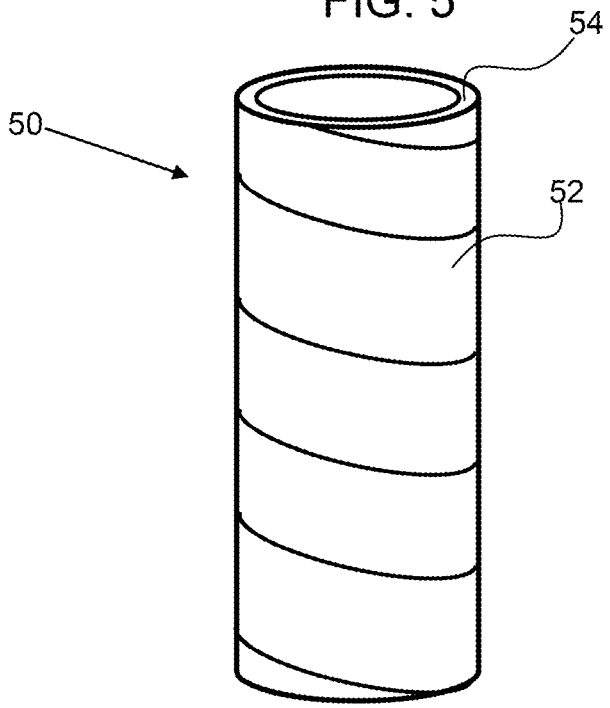
FIG. 6 show a perspective view of a selectively permeable tube.

Referring to FIGS. 5 and 6, a selectively permeable tube 50, which may an inner or outer tube in the tube-in-tube heat exchanger may have a selectively permeable layer 52 that is supported by a porous tube support 54. The selectively permeable layer may be coated onto the tube support or spirally wrapped as shown in FIG. 6.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A tube-in-tube heat exchanger comprising:

a) a selectively permeable tube comprising a selectively permeable layer and having an inside surface and an outside surface;

b) a non-permeable tube having an inside surface and an outside surface;

c) a flow of refrigerant;

d) a flow of an ionic liquid;

e) a flow of heat transfer fluid that exchanges heat with the flow of ionic liquid;

wherein the flow of refrigerant is along one of the inside or outside surfaces of the selectively permeable tube and wherein the flow of ionic liquid is along the other of the inside surface and outside surface of the selectively permeable tube;

wherein the refrigerant is transferred through the selectively permeable tube into the flow of ionic liquid;

wherein heat is transferred between ionic liquid and the heat transfer fluid.

2. The tube-in-tube heat exchanger of claim 1, wherein the ionic liquid is an endothermic ionic liquid having an endothermic heat of absorption and wherein the refrigerant is transferred from the flow of refrigerant to the flow of ionic liquid to cool the ionic liquid.

3. The tube-in-tube heat exchanger of claim 1, wherein the ionic liquid is an exothermic ionic liquid having an exothermic heat of absorption and wherein refrigerant is transferred from the flow of ionic liquid to the flow of refrigerant to the heat the ionic liquid.

4. The tube-in-tube heat exchanger of claim 1, wherein the tube-in-tube heat exchanger comprises an inner tube and an outer tube configured around said inner tube.

5. The tube-in-tube heat exchanger of claim 4, wherein the non-permeable tube is the inner tube of the tube-in-tube heat exchanger and wherein the selectively permeable tube is the outer tube of the tube-in-tube heat exchanger.

6. The tube-in-tube heat exchanger of claim 5, wherein the flow of heat transfer fluid is through the inner tube which is the non-permeable tube and wherein the flow of ionic liquid is between the inner and outer tube and wherein the flow of refrigerant is over the outside surface of the outer tube.

7. The tube-in-tube heat exchanger of claim 6, further comprising an outer shell and wherein the flow of refrigerant is between the outer shell and the outer tube.

8. The tube-in-tube heat exchanger of claim 4, wherein the non-permeable tube is the outer tube of the tube-in-tube heat exchanger and wherein the selectively permeable tube is the inner tube of the tube-in-tube heat exchanger.

9. The tube-in-tube heat exchanger of claim 8, wherein the flow of refrigerant is through the inner tube which is the selectively permeable tube and wherein the flow of ionic liquid is between the inner tube and outer tube and wherein the flow of refrigerant is through the inner tube.

10. The tube-in-tube heat exchanger of claim 9, further comprising an outer shell and wherein the flow of heat transfer fluid is between the outer shell and the outer tube.

11. The tube-in-tube heat exchanger of claim 1, wherein the selectively permeable layer comprises a proton conducting polymer.

12. The tube-in-tube heat exchanger of claim 11, wherein the proton conducting polymer comprises a perfluorosulfonic acid polymer.

13. The tube-in-tube heat exchanger of claim 1, wherein the selectively permeable layer comprises an anion conducting polymer.

14. The tube-in-tube heat exchanger of claim 13, wherein the anion conducting polymer comprises a quaternary ammonium functional group.

15. The tube-in-tube heat exchanger of claim 14, wherein the conducting polymer comprises a backbone selected from the group consisting of: poly(styrene), poly(phenylene), polybenzimidazole and poly(arylene).

16. The tube-in-tube heat exchanger of claim 1, wherein the selectively permeable layer comprises a non-ionic transfer medium.

17. The tube-in-tube heat exchanger of claim 16, wherein the non-ionic transfer medium is selected from the group consisting of: Ethylene-vinyl alcohol copolymer, polyethylene, polyester, polyether, polyamide, polyacrylonitrile, polyurethane, polyglycolide, polyvinylpyrrolidone, polyoxazoline or cellulose-based.

18. The tube-in-tube heat exchanger of claim 17, wherein the non-ionic transfer medium is a copolymer.

19. The tube-in-tube heat exchanger of claim 1, wherein the ionic liquid includes a cation selected from the group consisting of: pyridinium, pyridazinium, pyrimidinium, pyrazinium, imidazolium, pyrazolium, thiazolium, oxazolium, triazolium, phosphonium, and ammonium.

20. The tube-in-tube heat exchanger of claim 19, wherein the ionic liquid includes an anion selected from the group consisting of: $[CH_3CO_2]^-$, $[HSO_4]^-$, $[CH_3OSO_3]^-$, $[C_2H_5OSO_3]^-$, $[AlCl_4]^-$, $[CO_3]^{2-}$, $[HCO_3]^-$, $[NO_2]^-$, $[NO_3]^-$, $[PO_4]^{3-}$, $[HPO_4]^{2-}$, $[H_2PO_4]^-$, $[HSO_3]^-$, $[CuCl_2]^-$, $Cl^-$, $Br^-$, $I^-$, $SCN^-$, $[BF_4]^-$, $[PF_6]^-$, $[SbF_6]^-$, $[CF_3SO_3]^-$, $[HCF_2CF_2SO_3]^-$, $[CF_3HFCCF_2SO_3]^-$, $[HCClFCF_2SO_3]^-$, $[(CF_3SO_2)_2N]^-$, $[(CF_3CF_2SO_2)_2N]^-$, $[(CF_3SO_2)_3C]^-$, $[CF_3CO_2]^-$, $[CF_3OCFHCF_2SO_3]^-$, $[CF_3CF_2OCFHCF_2SO_3]^-$, $[CF_3CFHOCF_2CF_2SO_3]^-$, $[CF_2HCF_2OCF_2CF_2SO_3]^-$, $[CF_2ICF_2OCF_2CF_2SO_3]^-$, $[CF_3CF_2OCF_2CF_2SO_3]^-$, $[(CF_2HCF_2SO_2)_2N]^-$, $[(CF_3CFHCF_2SO_2)_2N]^-$, and $F^-$.

* * * * *